US007124467B2

(12) United States Patent
Hitzelberger et al.

(10) Patent No.: US 7,124,467 B2
(45) Date of Patent: Oct. 24, 2006

(54) EDGE CLEANING SYSTEM FOR VACUUM CLEANER

(75) Inventors: J. Erik Hitzelberger, Danville, KY (US); Eric J. Streciwilk, Perryville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 482 days.

(21) Appl. No.: 10/402,627

(22) Filed: Mar. 28, 2003

(65) Prior Publication Data

US 2003/0188396 A1 Oct. 9, 2003

Related U.S. Application Data

(60) Provisional application No. 60/370,941, filed on Apr. 8, 2002.

(51) Int. Cl.
*A47L 9/02* (2006.01)
*A47L 5/00* (2006.01)

(52) U.S. Cl. ..... 15/416; 15/331

(58) Field of Classification Search ..... 15/328, 15/331, 416

See application file for complete search history.

(56) References Cited

U.S. PATENT DOCUMENTS

| | | | | |
|---|---|---|---|---|
| 2,046,684 | A * | 7/1936 | Hoover | 15/334 |
| 3,936,903 | A | 2/1976 | Johnson | |
| 3,936,905 | A | 2/1976 | Stewart et al. | |
| 3,942,216 | A | 3/1976 | Minton | |
| 3,942,219 | A | 3/1976 | Johnson | |
| 4,023,234 | A | 5/1977 | Martinec et al. | |
| 4,198,727 | A | 4/1980 | Farmer | |
| 4,219,902 | A | 9/1980 | DeMaagd | |
| 4,959,885 | A * | 10/1990 | Sovis et al. | 15/335 |
| 6,039,817 | A | 3/2000 | Payne | |
| 6,052,866 | A | 4/2000 | Tuvin et al. | |
| 2004/0078922 | A1 * | 4/2004 | Park | 15/331 |

FOREIGN PATENT DOCUMENTS

| | | |
|---|---|---|
| GB | 2 378 643 | 2/2003 |

* cited by examiner

*Primary Examiner*—Gladys J P Corcoran
*Assistant Examiner*—Laura C Guidotti
(74) *Attorney, Agent, or Firm*—King & Schickli, PLLC

(57) ABSTRACT

A vacuum cleaner is provided with a canister assembly and a nozzle assembly. The nozzle assembly includes both a main inlet and an edge cleaning inlet. A dirt container and a fan and motor assembly/suction generator are carried on either the nozzle assembly or the canister assembly. An airflow system conveys a vacuum airstream from the nozzle assembly to the dirt container. The airflow system includes a control valve, a first conduit between the main inlet and the control valve, a second conduit between the edge cleaning inlet and the control valve and a third conduit between the control valve and the dirt container.

7 Claims, 5 Drawing Sheets

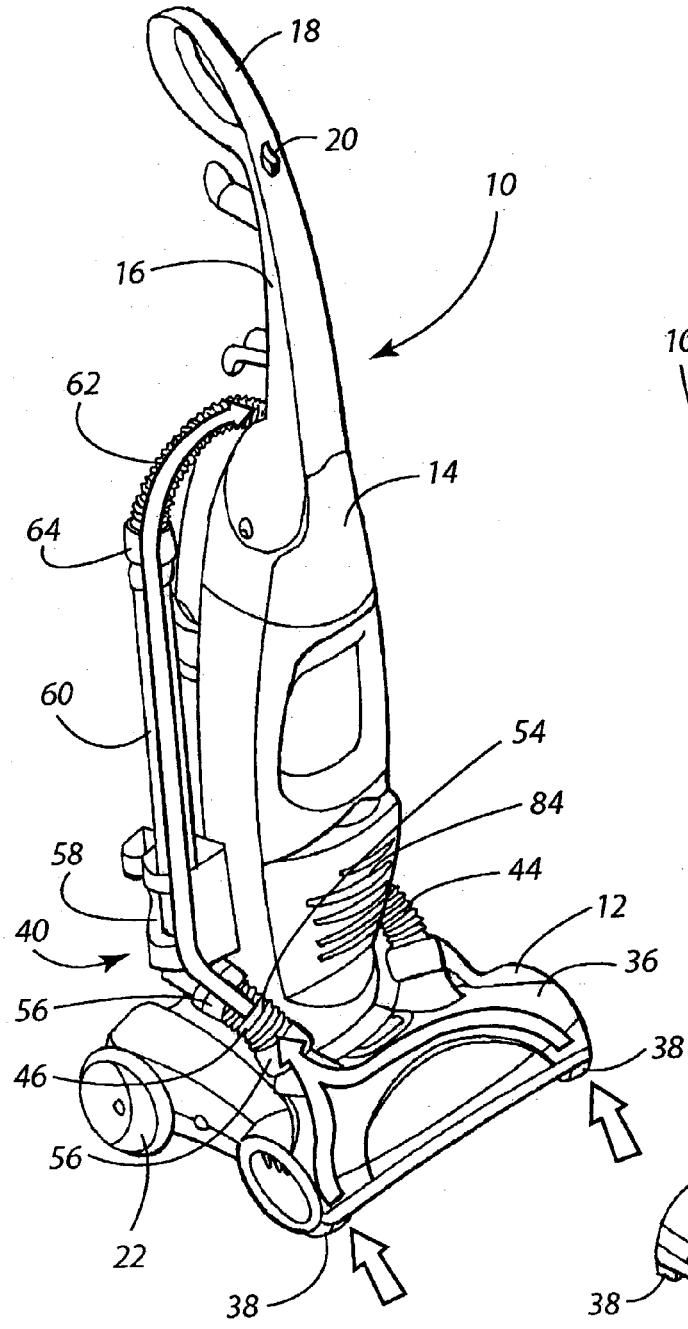
Fig. 1a
Fig. 1b
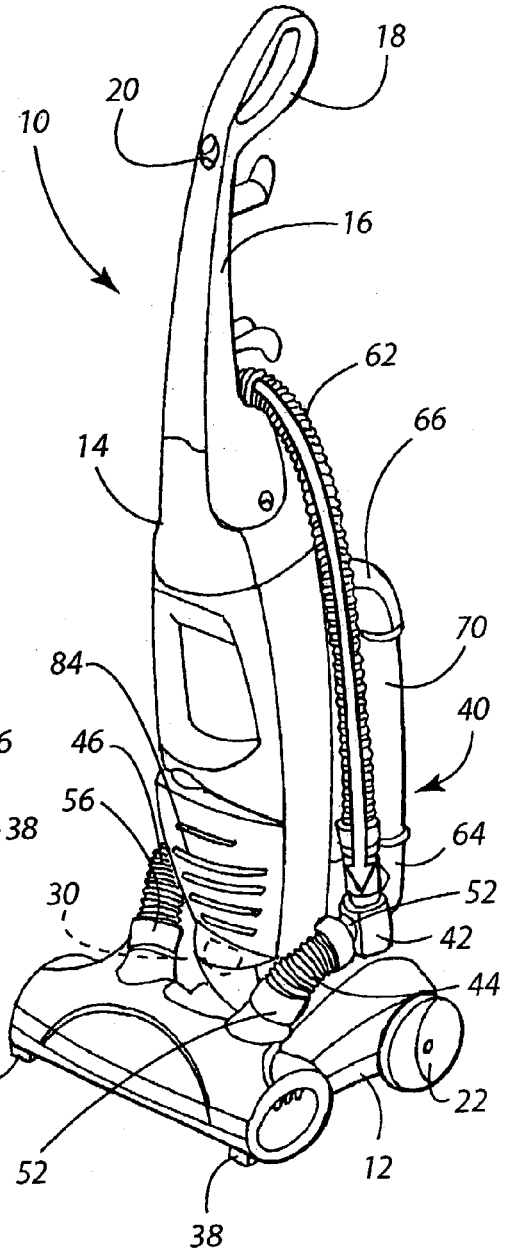

EDGE CLEANING SYSTEM FOR VACUUM CLEANER

This application claims the benefit of U.S. Provisional Patent Application Ser. No. 60/370,941 filed on Apr. 8, 2002.

TECHNICAL FIELD

The present invention relates generally to the vacuum cleaner art, and, more particularly, to a vacuum cleaner incorporating a novel edge cleaning system.

BACKGROUND OF THE INVENTION

Over recent years upright vacuum cleaners have enjoyed ever-increasing popularity. Upright vacuum cleaners generally incorporate a nozzle assembly which rides on wheels over the floor surface to be cleaned. A canister assembly is pivotally mounted to the nozzle assembly. The canister assembly includes an operating handle that is manipulated by an operator to move the vacuum cleaner back and forth across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action.

In most upright vacuum cleaners sold today, a rotary agitator is provided in the main inlet cavity of the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner. Generally, the rotary agitator is mounted transversely across the nozzle assembly and is supported on bearings at each end.

While a number of arrangements are utilized, it should be appreciated that the sidewalls of the nozzle adjacent the ends of the rotary agitator must incorporate some structural reinforcement to properly hold the agitator in position. As a result, there is not only a gap between the lateral ends of the rotary agitator and the sidewalls of the nozzle assembly but also generally a gap between the main inlet cavity and the outer edge of the sidewalls. Thus, with each passage of the nozzle assembly a narrow strip of underlying floor along each side of the nozzle assembly is not subjected to effective cleaning. Since dirt has a tendency to collect in the corner where the floor meets a wall along a baseboard and/or toestrip, ineffective edge cleaning along the sidewall of a nozzle assembly can be a serious problem that frustrates a vacuum cleaner user. The present invention is directed to a vacuum cleaner that very effectively addresses and resolves this problem.

SUMMARY OF THE INVENTION

In accordance with the purposes of the present invention as described herein, an improved vacuum cleaner is provided. The vacuum cleaner includes a canister assembly and a nozzle assembly. The canister assembly and nozzle assembly may be pivotally connected together. A dirt container is connected to either the nozzle assembly or the canister assembly. That dirt container includes a collection chamber for collecting dirt and debris being cleaned from the underlying floor by the vacuum cleaner.

A main inlet cavity is provided on the nozzle assembly. That main inlet cavity may hold an agitator for rotation relative to the nozzle assembly. The rotary agitator provides a positive force for beating and brushing dirt and debris from the nap of an underlying carpet.

At least one edge cleaning inlet is provided on the nozzle assembly adjacent at least one end of the main inlet cavity. Preferably, an edge cleaning inlet is provided at each side of the nozzle assembly: that is, one edge cleaning inlet is provided adjacent each transverse end of the main inlet cavity. Advantageously, the edge cleaning inlets function to draw air into the vacuum cleaner immediately adjacent the sidewalls of the nozzle assembly so as to provide good edge cleaning action along baseboards or the like so that dirt and debris will not collect in the corner where the floor and wall meet.

The vacuum also includes an airflow system for conveying the vacuum airstream from the nozzle assembly to the collection chamber. Specifically, the airflow system includes a control valve, a first airstream conduit providing fluid communication between the main inlet cavity and the control valve, a second airstream conduit providing fluid communication between the edge cleaning inlet and the control valve and a third airstream conduit providing fluid communication between the control valve and the collection chamber. A fan and motor assembly mounted to the canister assembly or the nozzle assembly generates a vacuum airstream that moves air entrained with dirt and debris through the airflow system from the main inlet cavity and/or edge cleaning inlet of the nozzle assembly into the collection chamber.

In accordance with yet another aspect of the present invention, the second airstream conduit includes a flexible hose section, a wand and wand coupler for securing the wand in fluid communication with the edge cleaning inlet. More specifically, the vacuum cleaner operator may draw the wand from the wand coupler and use the end of the wand or position a tool on the end of the wand in order to perform hand cleaning operations by manipulating the wand either on or above the floor.

The control valve includes a valve body that is selectively displaceable between a first position wherein both the first and second airstream conduits are in fluid communication with the third airstream conduit and a second position where only the second airstream conduit is in fluid communication with the third airstream conduit. Thus, in this second position of the valve body, airflow is interrupted to the main inlet cavity and the fan and motor assembly draws all its air either (a) through the edge cleaning inlet when the operator wishes to place emphasis on the edge cleaning function while, for example, manipulating the vacuum cleaner along a baseboard or (b) through the hand tool and wand when the wand is withdrawn from the wand coupler. In this first instance, this function allows for more efficient cleaning of the corner formed by the floor and wall. In the second instance, this function allows more efficient hand tool cleaning.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing:

FIGS. 1*a* and 1*b* are perspective views of the vacuum cleaner of the present invention demonstrating the flow of the vacuum airstream from the edge cleaning inlet to the control valve;

Figure 2:
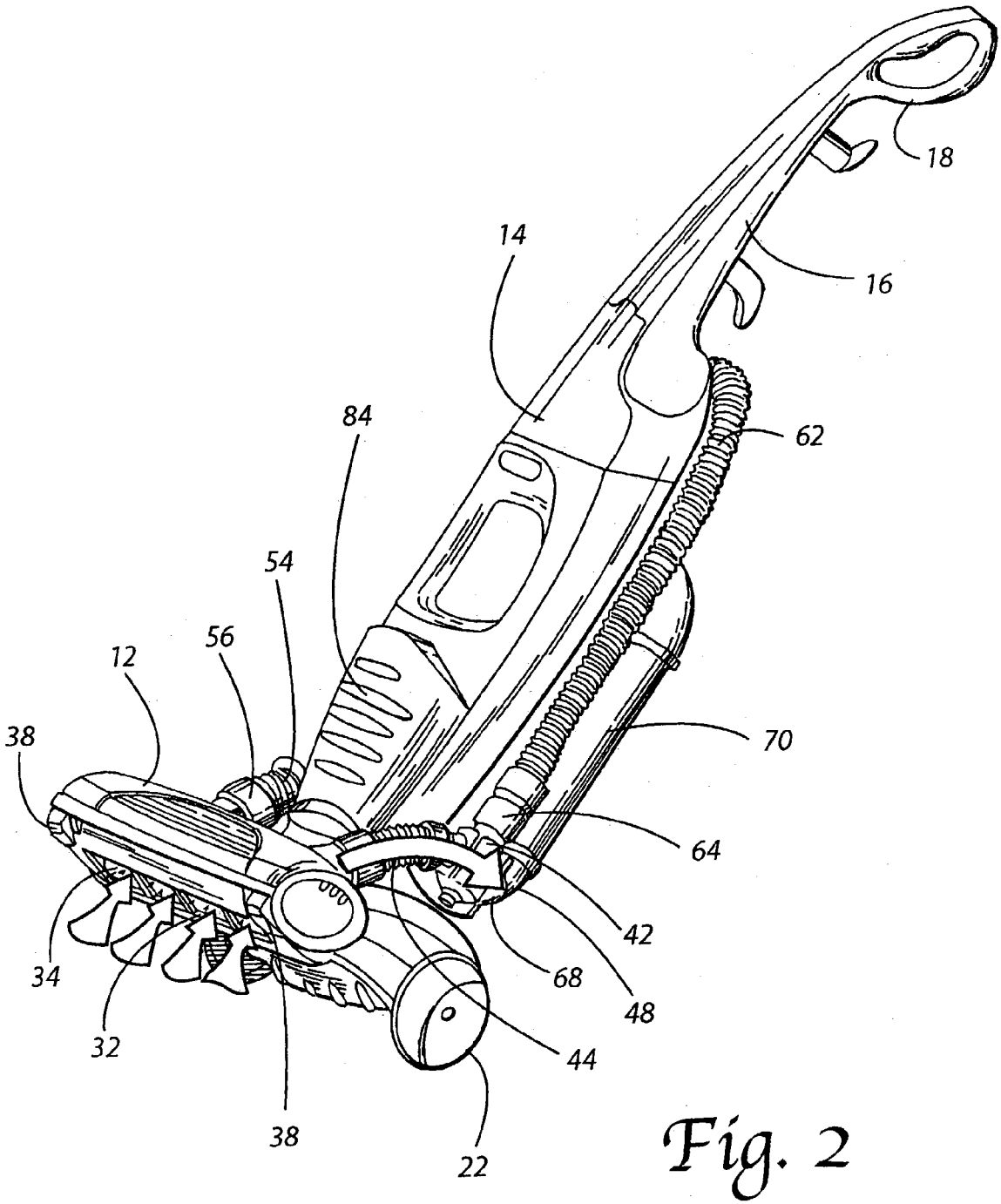
FIG. 2 is a perspective view of the vacuum cleaner illustrating airflow from the main inlet cavity to the control valve.
Figure 3:
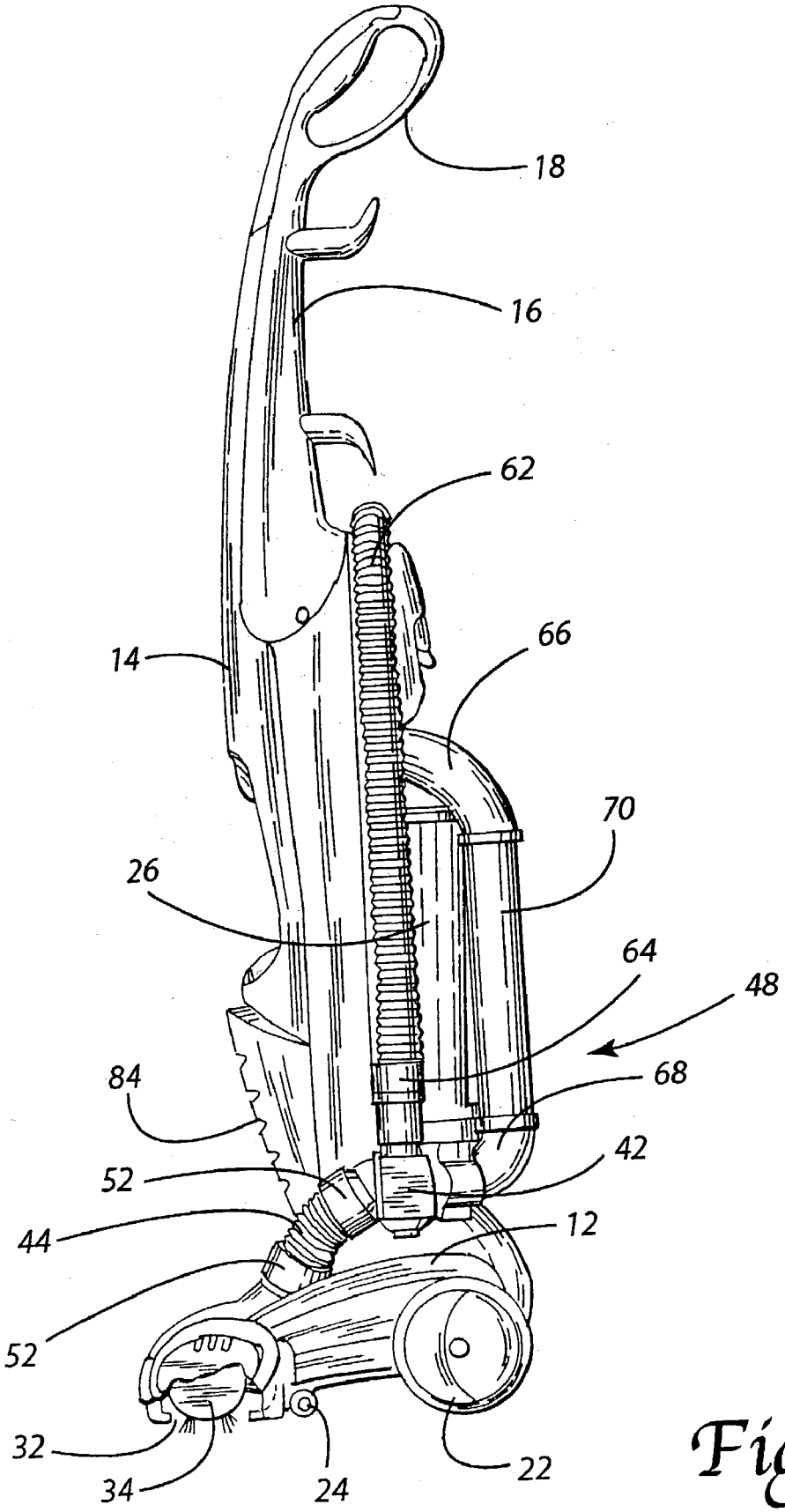
FIG. 3 is a side elevational view illustrating airflow from the control valve to the dirt container.

Reference will now be made in detail to the present invention, one possible embodiment of which is illustrated in the accompanying drawing.

DETAILED DESCRIPTION OF THE INVENTION

Reference is now made to the drawing figures illustrating an upright vacuum cleaner 10 of the present invention. The upright vacuum cleaner 10 includes a housing comprising a nozzle assembly 12 and a canister assembly 14. The canister assembly 14 further includes a control handle 16 and a hand grip 18. A control switch 20 is provided for turning the vacuum cleaner on and off. Of course, electrical power is supplied to the vacuum cleaner 10 from a standard electrical wall outlet through a cord (not shown).

A pair of rear wheels 22 (partially shown) are provided on a lower portion of the canister assembly 14 and a pair of front wheels 24 are provided on the nozzle assembly 12. Together, these wheels 22, 24 support the vacuum cleaner 10 for movement across the floor. To allow for convenient storage of the vacuum cleaner 10, a foot latch (not shown) functions to lock the canister assembly 14 in an upright position as shown in FIG. 1*a*. When the foot latch is released, the canister assembly 14 may be pivoted relative to the nozzle assembly 12 as the vacuum cleaner 10 is manipulated back and forth to clean the floor.

In the present preferred embodiment, the canister assembly 14 includes a cavity adapted to receive and hold a dirt container 26 which includes a collection chamber 28. A suction fan and drive motor assembly 30 carried on the canister assembly 14 functions to generate a vacuum airstream for drawing dirt and debris from a surface to be cleaned. While the suction fan and drive motor assembly 30 is illustrated as being carried on the canister assembly 14, it should be appreciated that it could likewise be carried on the nozzle assembly 12 if desired.

The nozzle assembly 12 includes a main inlet cavity 32 that houses an agitator 34 which is rotated by a motor relative to the nozzle assembly. The nozzle assembly 12 also includes edge cleaning inlet 36. As illustrated, the inlet 36 is substantially U-shaped so as to provide an inlet opening 38 at the front edge of the nozzle assembly 12 immediately adjacent the lateral ends of the main inlet cavity 32. By positioning the inlet openings 38 at the forward corners of the nozzle assembly 12, the vacuum cleaner 10 provides effective and efficient cleaning adjacent the sidewalls of the nozzle assembly for efficient cleaning along baseboards, toe strips and the like even in room corners.

The main inlet cavity 32 and edge cleaning inlet 36 of the nozzle assembly 12 are provided in fluid communication with the collection chamber 28 of the dirt container 26 by means of an airflow system generally designated by reference numeral 40. The airflow system 40 includes a control valve 42, a first airstream conduit 44, a second airstream conduit 46 and a third airstream conduit 48. More specifically, the first airstream conduit 44 provides fluid communication between the main inlet cavity 32 housing the rotary agitator 34 and the control valve 42. As illustrated, the first airstream conduit 44 may take the form of a flexible hose with removable couplings 52 at each end. Of course, it should be appreciated that this is just one possible embodiment of the first airstream conduit.

The second airstream conduit 46 provides fluid communication between the edge cleaning inlet 36 and the control valve 42 (note FIGS. 1*a* and 1*b*). As illustrated, the second airstream conduit 46 comprises a first flexible hose 54 having couplings 56 at each end, a wand coupler 58, a manipulatable wand 60 and a second flexible hose 62 having couplers 64 at each end for connecting between the wand 60 and the control valve 42. Of course, the detailed structure illustrated and described for the second airstream conduit 46 is exemplary of only one possible embodiment of the present invention and it should not be considered as being limited thereto.

The third airstream conduit 48 provides fluid communication between the control valve 42 and the inlet 66 of the dirt container 26. In the illustrated embodiment the third airstream conduit comprises a solid plastic elbow 68 and straight tubing 70. Of course, it should be appreciated once again that this is just one possible embodiment and the invention should not be limited to this specific structure.

Figure 5:
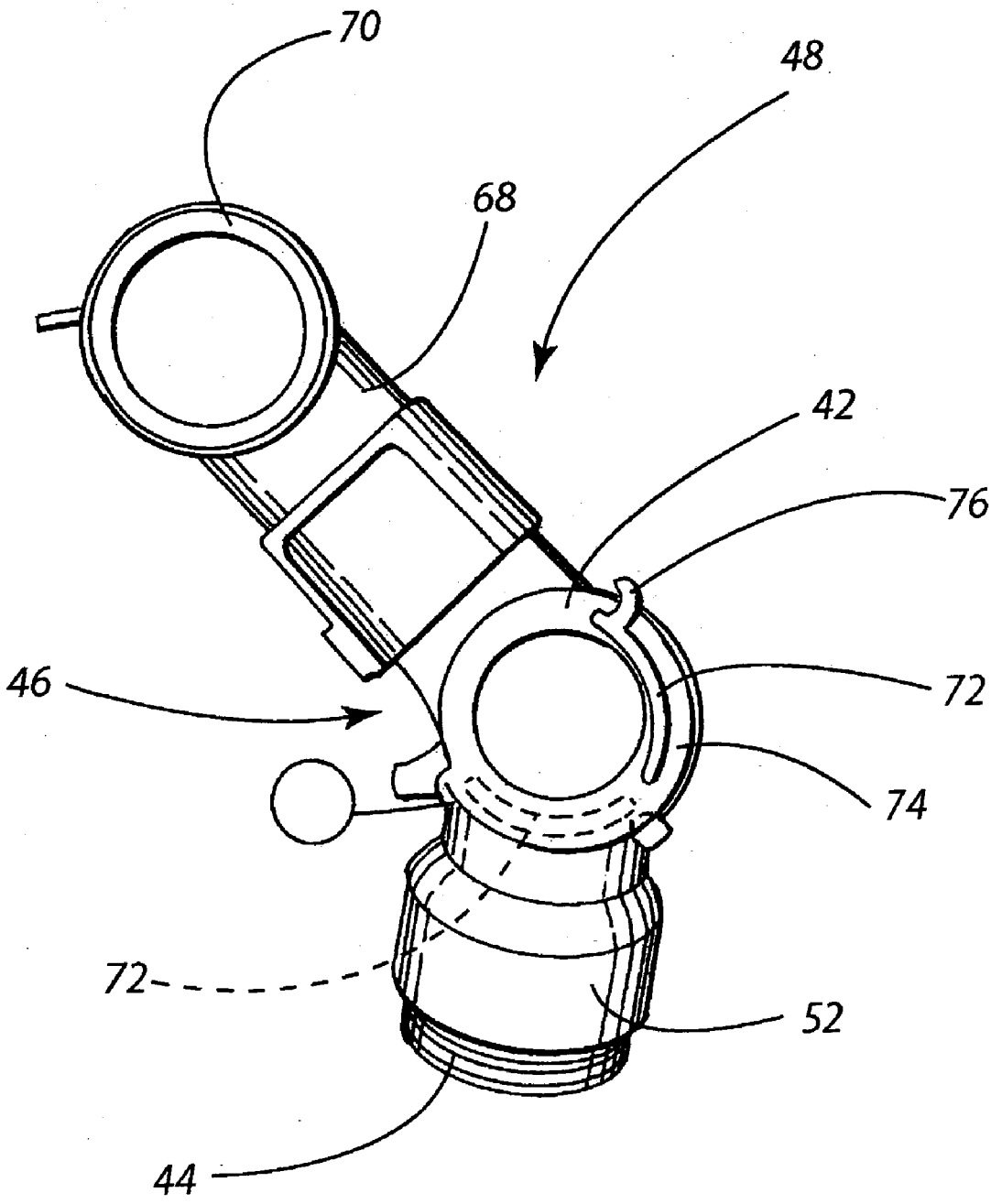
FIG. 5 is a top plan view schematically illustrating the valve body of the control valve.

As best illustrated in FIG. 5, the control valve 42 includes a valve body 72 in the form of a curved plate that is held in and slides in a guide track or groove formed in the sidewall 74 of the control valve. An actuator 76 projects from the valve body 72 through an opening in the sidewall 74. When the valve body 72 is in the first position shown in full line in drawing FIG. 5, both (a) the first airstream conduit 44 and main inlet cavity 32 and (b) the second airstream conduit 46 and edge cleaning inlet 36 are in fluid communication with the third airstream conduit 48 leading to the collection chamber 28 of the dirt container 26 and the downstream suction fan and drive motor assembly 30. In contrast, when the valve body 42 is in the second position illustrated in phantom line in FIG. 5, airflow through the first airstream conduit 44 leading to the main inlet cavity 32 is interrupted and only the second airstream conduit 46 leading to the edge cleaning inlet 36 is in communication with the third airstream conduit leading to the collection chamber 28 and suction fan and drive motor assembly 30.

Figure 4:
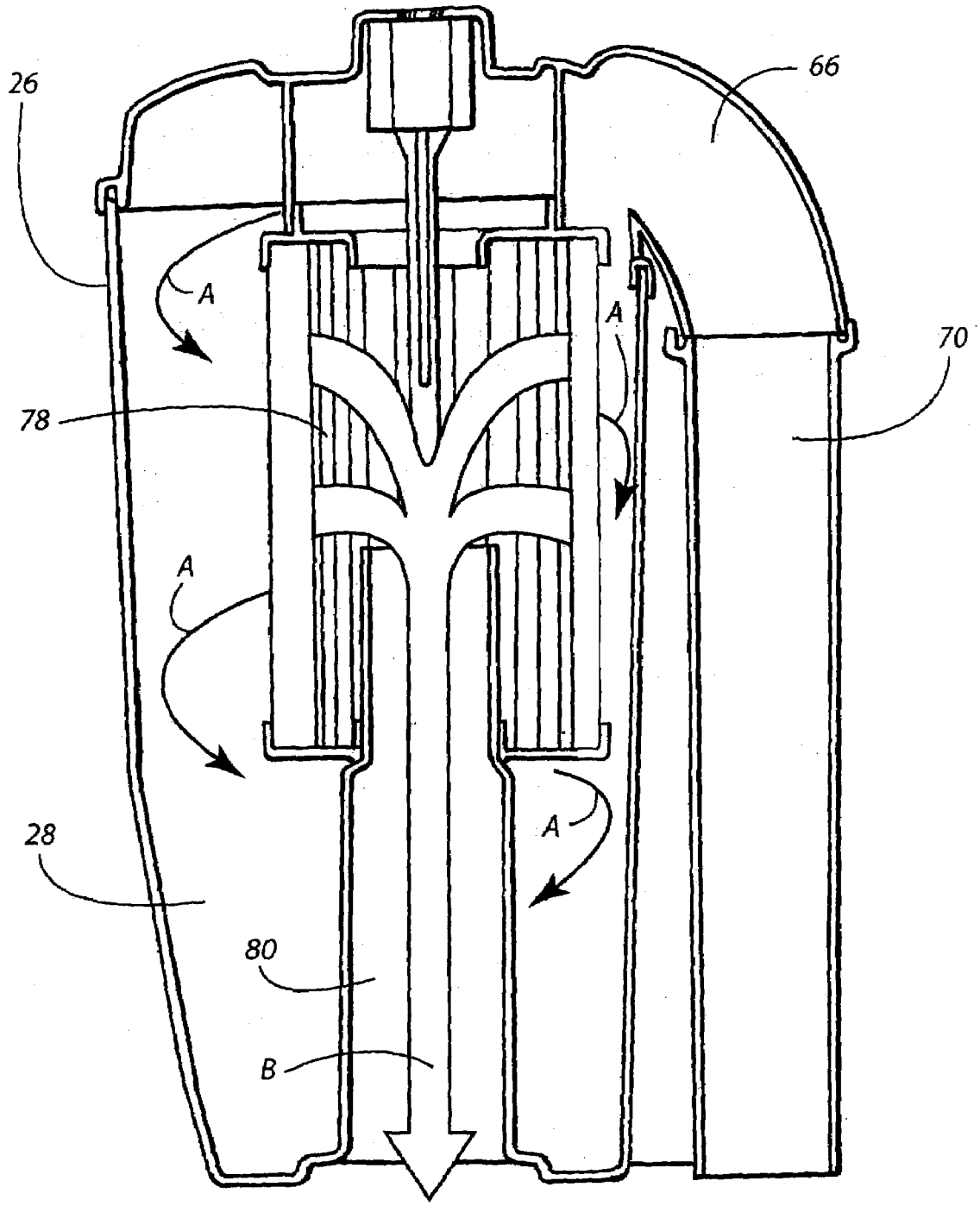
FIG. 4 is a schematical cross-sectional view of the dirt cup showing the cyclonic airflow in the collection chamber and the passage of air through the filter and out the concentrically located discharge conduit.

The operation of the vacuum cleaner 10 of the present invention will now be described in detail. During normal operation, the valve body 72 is placed in the first position illustrated in full line in drawing FIG. 5. As noted above, in this position both of the first and second airstream conduits 44, 46 are provided in fluid communication with the third airstream conduit 48. Accordingly, the fan and motor assembly 30 draws air and entrained dirt and debris through the main inlet cavity 32 and the edge cleaning inlet 36, up, respectively, the first airstream conduit 44 and second airstream conduit 46, through the control valve 42, up the third airstream conduit 48, and then through the inlet 66 into the collection chamber of the 28 of the dust container 26. The inlet 66 directs that airstream so that it flows tangentially around the collection chamber 28 (note action arrows A in FIG. 4). The resulting centrifugal force causes heavier dirt and debris to move outwardly against the sidewall of the dust container 26 where it gradually settles and collects on the floor thereof. The air is then drawn through the main filter assembly 78 which may comprise a porous pleated filter or like material which screens remaining dirt and debris from the airstream while allowing the air to pass through the filter material and down the discharge conduit 80 (note action arrow B). From there the air passes through a filter pad (not shown) into the compartment housing the fan and drive motor assembly 30. After passing over and cooling the motor, that air is discharged through a HEPA filter (not shown) through an exhaust port 84 into the environment.

At certain times and during particular cleaning operations such as when cleaning along baseboards or when desiring to use the cleaning tools, the operator may wish to direct the full suction power of the fan and motor assembly 30 through the second airstream conduit 46. In order to do this, the operator engages the actuator 76 and slides the valve body 72 to the second position illustrated in phantom outline in FIG. 5. In this position, the valve body 72 blocks and interrupts airflow through the first airstream conduit 44. As a result, the fan and motor assembly 30 draws all of its air through the edge cleaning inlet 36 and the second airstream conduit 46, control valve 42 and third airstream conduit 48 into the collection chamber 28. This allows the most efficient and effective edge cleaning when the vacuum cleaner is operated along, for example, a baseboard or toe strip so as to better clean the corner formed by the floor and wall.

When the operator desires to use a cleaning tool, the operator grasps the wand 60 and removes the lower end of the wand from the wand coupler 58. A hand cleaning tool or nozzle may then be positioned on the open end of the wand 60 or the open end of the wand may actually be utilized to suck dirt and debris into the collection chamber 28. Of course, suction power may be easily restored to the edge cleaning inlet 36 by removing any wand tool or attachment and inserting the end of the wand 60 back into the wand coupler 58.

In summary, numerous benefits result from employing the concepts of the present invention. By simple and convenient operation of the control valve 42, the vacuum cleaner operator may operate the vacuum cleaner in a normal cleaning mode, drawing dirt and debris into the vacuum cleaner through operation of the rotary agitator 34 and suction power generated by the fan and motor assembly 30. Since air is also drawn through the edge cleaning inlet 36, good edge cleaning is also provided.

When desired, the operator may adjust vacuum cleaner operation for most efficient cleaning along a baseboard or toe strip by interrupting airflow to the main inlet cavity 32 and directing the entire suction power of the fan and motor assembly 30 through the edge cleaning inlet 36. Similarly, the operator may direct the entire cleaning power of the fan and motor assembly 30 through a cleaning tool or attachment by withdrawing the wand 60 from the wand coupler 58 and placing the valve body 72 of the control valve 42 in the second operating position.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, the vacuum cleaner need not even be equipped with an agitator of any kind. Still further, the dust container 26 need not provide for cyclonic airflow or could even be replaced by a filter bag held in an enclosure in the canister assembly. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A vacuum cleaner, comprising:

a canister assembly;

a nozzle assembly;

a dirt container carried by one of said canister assembly and said nozzle assembly, said dirt container including a collection chamber;

a main inlet cavity on said nozzle assembly;

at least one edge cleaning inlet on said nozzle assembly adjacent at least one end of said main inlet cavity;

an airflow system for conveying a vacuum airstream from said nozzle assembly to said collection chamber, said airflow system including a control valve, a first airstream conduit providing fluid communication between said main inlet cavity and said control valve, a second airstream conduit providing fluid communication between said at least one edge cleaning inlet on said nozzle assembly and said control valve and a third airstream conduit providing fluid communication between said control valve and said collection chamber; and a fan and motor assembly for generating said vacuum airstream and moving dirt and debris through said airflow system into said collection chamber said fan and motor assembly being carried by one of said canister assembly and said nozzle assembly;

said vacuum cleaner being characterized by said second airstream conduit including a flexible hose section, a wand and a wand coupler for securing said wand in fluid communication between said at least one edge cleaning inlet and said control valve.

2. The vacuum cleaner of claim 1, wherein said control valve includes a valve body that is selectively displaceable between a first position wherein both said first and said second airstream conduits are in fluid communication with said third airstream conduit and a second position wherein only said second airstream conduit is in fluid communication with said third airstream conduit.

3. The vacuum cleaner of claim 1, wherein an agitator is mounted in said main inlet cavity for rotation relative to said nozzle assembly.

4. The vacuum cleaner of claim 1, wherein said dirt container is a dirt cup.

5. The vacuum cleaner of claim 1, wherein said dirt container is a filter bag.

6. The vacuum cleaner of claim 1, wherein said canister assembly is pivotally connected to said nozzle assembly.

7. The vacuum cleaner of claim 1, wherein said at least one edge cleaning inlet is substantially U-shaped and includes two inlet openings.

* * * * *